US006523479B1

(12) United States Patent
Schilke et al.

(10) Patent No.: US 6,523,479 B1
(45) Date of Patent: Feb. 25, 2003

(54) AMUSEMENT RIDES AND METHODS

(75) Inventors: Alan Schilke, Eden, UT (US); Fred W. Bolingbroke, Syracuse, UT (US); Joseph Trillo, Layton, UT (US); Alan Camomile, Bountiful, UT (US); Jan Bruening, Riverton, UT (US); Peter Hines, Ogden, UT (US); Gary Bird, Ogden, UT (US); Gary Iser, Layton, UT (US)

(73) Assignee: S&S-Arrow, LLC, Logan, UT (US)

( * ) Notice: Subject to any disclaimer, the term of this patent is extended or adjusted under 35 U.S.C. 154(b) by 0 days.

(21) Appl. No.: 09/947,482

(22) Filed: Sep. 6, 2001

(51) Int. Cl.[7] ..... A63G 1/00
(52) U.S. Cl. ..... 104/57; 104/63
(58) Field of Search ..... 104/53, 55, 56, 104/57, 63

(56) References Cited

U.S. PATENT DOCUMENTS

| | | | | |
|---|---|---|---|---|
| 142,605 | A | | 9/1873 | Yates |
| 567,861 | A | | 9/1896 | Mustain |
| 728,246 | A | | 5/1903 | Kremer |
| 771,322 | A | | 10/1904 | Pattee |
| 803,465 | A | | 10/1905 | Bernheisel |
| 815,210 | A | | 3/1906 | Pattee |
| 815,211 | A | | 3/1906 | Pattee et al. |
| 887,082 | A | | 5/1908 | Fraser |
| 901,435 | A | | 10/1908 | Fuller |
| 944,407 | A | | 12/1909 | Beebe |
| 995,945 | A | | 6/1911 | Berhold |
| 2,009,904 | A | | 7/1935 | Purves |
| 2,535,862 | A | | 12/1950 | Pewitt |
| 3,299,565 | A | | 1/1967 | Yarashes |
| 3,610,160 | A | | 10/1971 | Alimanestianu |
| 3,777,835 | A | | 12/1973 | Bourne |
| 4,170,943 | A | | 10/1979 | Achrekar |
| 4,272,093 | A | | 6/1981 | Filice et al. |
| 4,501,434 | A | | 2/1985 | Dupuis |
| 4,531,459 | A | | 7/1985 | Yamada |
| 5,272,984 | A | | 12/1993 | Bolliger |
| 5,433,153 | A | * | 7/1995 | Yamada ..... 104/241 |
| 5,463,962 | A | | 11/1995 | Gnezdilov |
| 5,595,121 | A | | 1/1997 | Elliott et al. |
| 5,791,254 | A | | 8/1998 | Mares et al. |
| 6,047,645 | A | | 4/2000 | Cornwell et al. |
| 6,060,847 | A | | 5/2000 | Hettema et al. |
| 6,098,549 | A | | 8/2000 | Mares |
| 6,269,749 | B1 | * | 8/2001 | Hogg ..... 104/124 |
| 6,269,750 | B1 | * | 8/2001 | Cornwell et al. ..... 104/124 |

* cited by examiner

*Primary Examiner*—S. Joseph Morano
*Assistant Examiner*—Robert J. McCarry, Jr.
(74) *Attorney, Agent, or Firm*—James L. Sonntag; Parsons Behle & Latimer

(57) ABSTRACT

Amusement rides and methods are described. The amusement rides of the present invention include roller coaster vehicles that have a controlled spin or controlled rotation in a direction or dimension independent from the track of the roller coaster. The controlled rotation or spin is provided by using displacement of the track configuration to power a proportional rotation of the vehicle.

25 Claims, 11 Drawing Sheets

AMUSEMENT RIDES AND METHODS

FIELD OF THE INVENTION

The present invention relates to amusement rides and methods for using the same. In particular, the present invention relates to roller coasters and methods of using the same. Specifically, the present invention relates to roller coasters having a controlled spin or controlled rotation.

BACKGROUND OF THE INVENTION

Since the early days of roller coasters, manufacturers have experimented with variations of a central theme, which is to provide amusement to riders seated inside vehicles or cars traveling along tracks. Traditional roller coaster cars travel along double rail tracks and provide their riders with stationary seats or harnesses fixing the motion of the riders to the direction of travel of the cars (and of the track). The general effect attained by traditional roller coasters statically couples riders to their cars and the riders therefore experience essentially the same motions and gravitational forces experienced by the cars in which they ride. See, for example, U.S. Pat. Nos. 5,463,962, 5,595,121, and 6,060,847, the disclosures of which are incorporated herein by reference.

Some amusement devices, including roller coasters, attempt to deliver additional systems of rotation. See, for example, U.S. Pat. Nos. 142,605, 567,861, 728,246, 771, 322, 803,465, 815,210, 815,211, 887,082, 901,435, 944,407, 995,945, 2,009,904, 2,535,862, 3,610,160, 3,299,565, 3,777, 835, 4,272,093, 4,501,434, 5,433,153, 5,791,254, and 6,098, 549, the disclosures of which are incorporated herein by reference. There also exist amusement rides that typically depart from the conventional roller coaster in that the passenger vehicle no longer assumes the standard railway car configuration on the track. See, for example, U.S. Pat. Nos. 4,170,943, 5,272,984, and 6,047,645, the disclosures of which are incorporated herein by reference.

Unfortunately, these known roller coasters are limited in their abilities and functions. Many of the roller coasters do not have the ability for a user to rotate in a direction or dimension independent from the track, especially without using additional energy. Further many roller coasters are not able to rotate or spin in a controlled manner, especially based on the track configuration.

SUMMARY OF THE INVENTION

The present invention provides amusement rides and methods for using the same. The amusement rides of the present invention include roller coaster vehicles that have a controlled spin or controlled rotation in a direction or dimension independent from the track of the roller coaster. The controlled rotation or spin is provided by using the forward motion of the vehicle, using the track configuration to control or determine the rotation of the vehicle.

The invention is particularly suited for roller coaster rides where the forward motion of the vehicle is provided by gravity. However, the principles of the invention may be satisfactorily applied to flat rides or tower rides. The amusement ride comprises a track system. One portion of the track system is referred herein as having a normal configuration. In tracked rides in general, there is at least one guide rail the guides a vehicle. For reasons that will become evident below, the present invention requires at least two or more rails, i.e., a first and second rail. In general, the rails multi-rail tracks are generally parallel and are equidistant from one another through the rail system. The system for connecting the vehicle to the rails comprises wheels that are fixed in position relative to one another. The present invention functions by deviating from this normal configuration by deviating from this fixed equidistant spacing. This is accomplished by displacing one or more rails relative to one another in portions of the track system referred to herein as displaced portions. In the displaced configuration in these portions the relative position of the rails have been displaced from the normal configuration.

The vehicle system of the present invention is constructed according to known construction techniques consistent with the invention. The vehicle is system is connected to the track system by a connection system. The connection system contains conventional structures, such as wheeled trucks and bogies for maintaining the vehicle on the track as it travels down the track. These wheeled systems are consistent with conventional practice.

However, in addition, the connection system comprises structure that responds in proportion to the deviation or displacement of the track system from the normal configuration. This response is translated into a rotary motion that is independent of the track structure. As described above, amusement rides have been constructed with track configurations, such as looped, helical, and the like, that impart rotating movement of the vehicle around an axis. There are also amusement rides where the vehicle is rotated and powered on different axis by an independent moving structure. However, in the present invention, the vehicle is rotated in response to and powered through the track system configuration. When a rail is displaced, structure in the connection system allows the attachment the rails (the wheels) to follow the displacement. The wheels are in turn connected to structure that translates this track-induced movement to a rotational movement that drives rotation of the vehicle around an axis. Accordingly, the extent of rotation is controlled by the extent of displacement, because the amount of movement is proportional to the amount of displacement of the rail. In addition, no separate power is required to make the vehicle rotate, for the forward movement of the vehicle across along the track powers the displacement of the wheels as they move along the displace rail.

Although described mostly in reference to roller-coaster rides in the description below, the present invention can be applied to any ride involving vehicles traveling along a track. The rotation of the vehicle is derived from the forward motion of the vehicle and does not derive from or require separately powered motors or the like. Thus, there is no requirement of the separate power supply system, such as electrical bus bars or rails that parallel the track. As the vehicle is carried along the track, by gravity, or any propulsion means, the variation in distance between first and second rails transfers the power to the vehicle to bring about the rotation. The invention includes rides where a tracked vehicle is brought to an apex by, for example, a chain, elevator, or a launch system, and allowed to fall or travel by gravity. Such include roller coasters, and vertical tracked systems. The invention also contemplates systems that are propelled by any suitable propulsion systems other than gravity. These include systems propelled by, for example electric, hydraulic, pneumatic, internal combustion, steam, and combination of any of these. It should be noted here that the rotation of the vehicle is not directly powered by any of these propulsion systems, but incidentally derives it power from the operable connection of the variably spaced track system with the connection system to the vehicle as the vehicle travels forward by action of the propulsion system or gravity.

BRIEF DESCRIPTION OF THE DRAWINGS

FIGS. 1 to 9 presented in conjunction with this description are views of only particular—rather than complete—portions of the amusement rides and methods of using the same.

DETAILED DESCRIPTION OF THE INVENTION

The following description provides specific details in order to provide a thorough understanding of the present invention. The skilled artisan, however, would understand that the present invention can be practiced without employing these specific details. Indeed, the present invention can be practiced by modifying the illustrated roller coaster and method and can be used in conjunction with apparatus and techniques conventionally used in the industry. For example, the present invention is described below with reference to roller coasters, but could be easily modified for other amusement rides such as tower rides and flat rides.

The amusements rides (i.e., roller coasters) of the present invention comprise at least three major elements. First, the amusement rides of the present invention comprise a track system containing at least two rails, a first rail and a second rail, the first and second rail having a base (or normal) location or configuration with respect to the other rail. Along at least one portion of the track system, the position of one (or both) of the rails deviates from that base location to displaced position or location.

Second, the amusement rides of the present invention comprise a vehicle system in which a user (or rider) rides. The vehicle system comprises structure for restraining the rider in the vehicle as well as structure connected to the connection system that allows the vehicle system to rotate or spin in a controlled manner.

Third, the present invention comprises a system for connecting the vehicle system to the track system. The connection system can be separate from the track system or vehicle system, part of the track system, part of the vehicle system, or a part of both. The connection system also contains a system for translating the deviation or displacement of the rails into rotation system to rotate the vehicle system.

Figure 1:
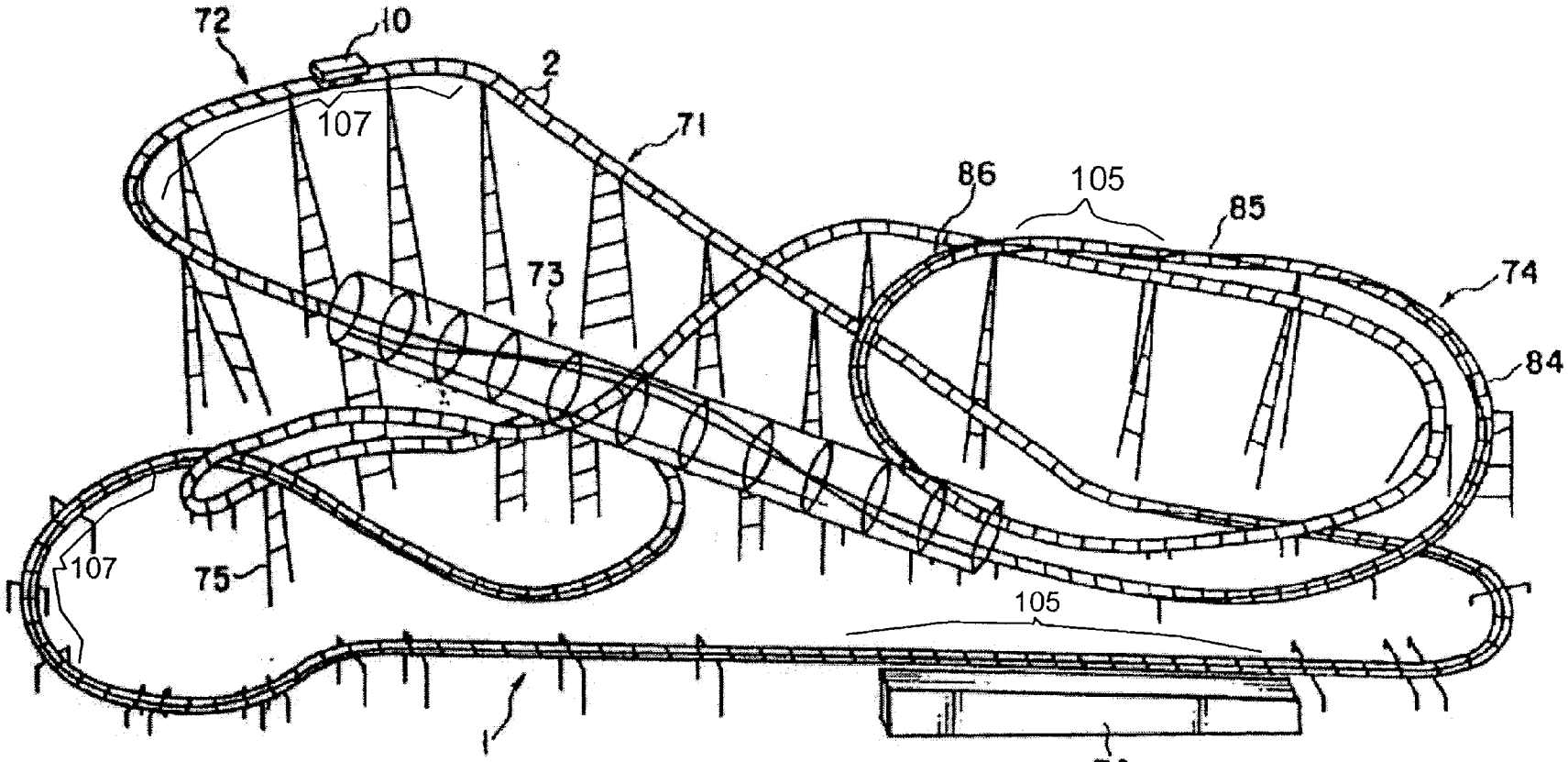
FIG. 1 is a schematic of an illustrative amusement ride of the invention.

One aspect of the present invention is illustrated in FIG. 1, which schematically depicts one configuration of the track system 1 of the present invention. The track system 1 comprises track at least one set of rails 2. The set of rail can comprise two rails as illustrated (one first rail 101 and one second rail 103), three rails (two or either the first or second rail) or four rails (two each of the first and second rail). More first and second rails are also contemplated, as well third rail that follow yet another displacement.

The rails within a given set are arranged substantially parallel to each other in a normal configuration throughout a portion of the track system. In other portions, the track is in a displaced portion.

Track system 1, typically—but not necessarily—is configured in the form of a loop, whether circular or otherwise. Platform 70 is located beside the lowest portion of track 1. Riders 10 typically board and exit the vehicle system (described below) of the present invention at platform 70. After leaving the platform 70, the vehicle system advances to hoisting section 71, where it is pulled up an upgrade by suitable mechanism, such as a chain or a similar mechanism. The vehicle system is pulled up through hoisting section 71 to portion 72, the highest point of the track 1, where it is released from the chain. Thereafter, the vehicle system automatically travels through the remainder of the track 1 by gravity. If necessary, the track system can contain additional hosting sections to provide the additional vertical heights necessary for the vehicle system to be powered by gravity.

The track system—and the track—can have various configurations of bends, twists, curves, helixes, spins, or other shapes as known in the art. One example of a configuration is illustrated in FIG. 1, which includes straight spinning section 73 and curved spinning section 74. In spinning section 73, the vehicle falls straight in a spin. After passing through the section 73, the vehicle system enters curved spinning section 74. In this spinning section 74, the vehicle system further spins as it travels along a curve, thus making a complex motion. After passing through section 74, the vehicle can move past a plurality of other curves or shapes, and then returns to platform 70 while reducing its speed.

Typically, the rails in the track a roller coaster run parallel to each other on a plane with a given orientation. The orientation is usually horizontal, but various inclines can be employed to give a rider a different sensation. See, for example, U.S. Pat. Nos. 5,433,153, 5,463,962, 6,047,645, the disclosures of which are incorporated by reference. The rails 2 of the present invention can have a normal or base configuration along certain portions of the track system.

The normal portions 105 of the track system land displaced portions 107 of the track system 1 can be placed at any place in the track system that is selected by the builder. (Not all portions 105, 107 are labeled.) Thus, in addition to the motions from the track configuration (spinning, curving, etc.) the vehicle is rotated in proportion to the displacement of the rails.

Figure 2A:
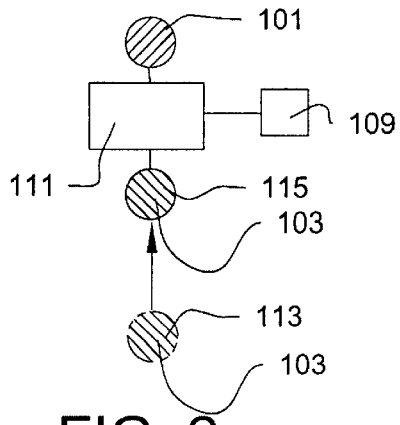
FIGS. 2*a*, 2*b*, 2*c*, 2*d*, 2*e*, 2*f*, and 2*g* illustrate various displaced configurations of the rails of the track system of the present invention.
Figure 2B:
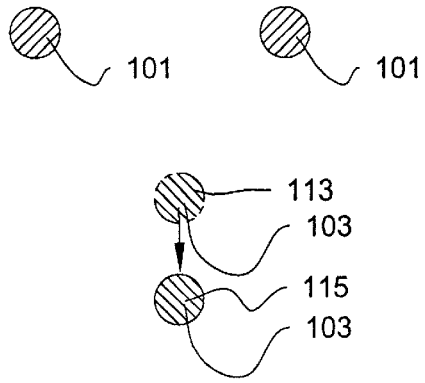
Figure 2C:
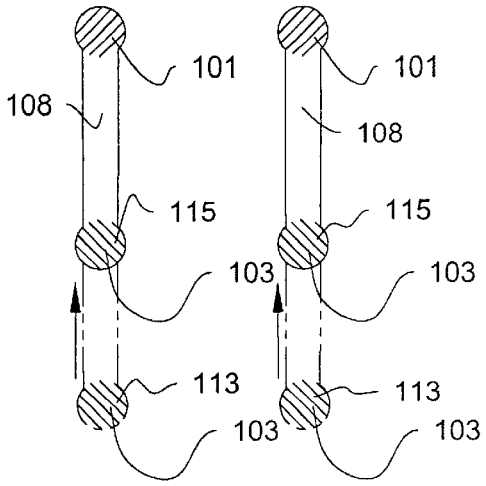
Figure 2D:
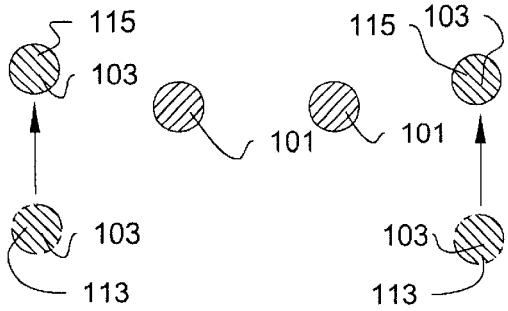
Figure 2E:
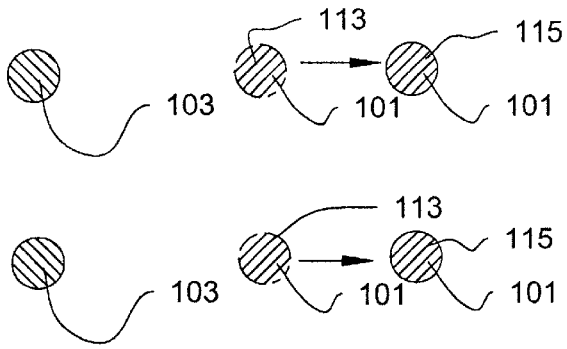
Figure 2F:
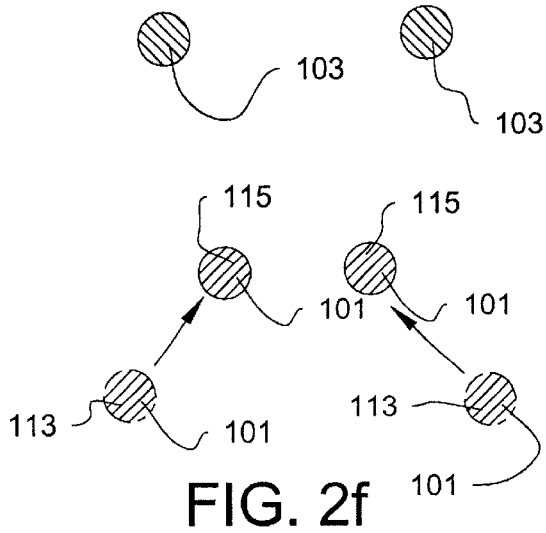
Figure 2G:
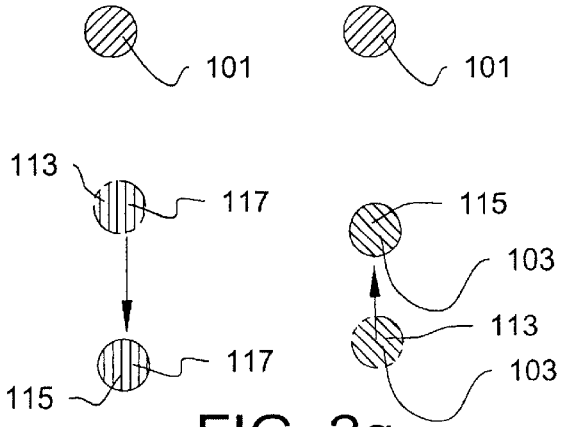

Reference is now made to FIGS. 2*a*, 2*c*, 2*c*, and 2*d*, which are cross-sections of different displaced configurations 115 as compared to normal configurations 113. The normal configuration 113 is shown schematically in phantom. FIG. 2*a* also shows a schematic of the vehicle system 109 and connection system 111, (not to scale). In the displaced portions of the track the rails of the track can have an alternate or displaced configuration that deviates from the normal configuration. In this displaced configuration, the position of at least one of the rails is changed or deviated from the normal position. This deviation from the normal position (or configuration) is illustrated by the arrows in FIGS. 2*a*, 2*b*, 2*c*, 2*d*, 2*f*. FIG. 2*a* illustrates a two-rail system, one first rail and one second rail, which has been displaced relative to the first rail as shown by the arrow. FIG. 2*b* illustrates a three-rail system, two first rails and one second rail. Displacement of the relative positions of the first and second rails is shown by the arrows. FIGS. 2*c*, 2*d*, and 2*e* illustrate a four-rail system (two first rails and two second rails). The deviation or displacement of the rail(s) can be in any desired direction, such as the vertical direction as depicted in FIGS. 2*c* and 2*d* (and further illustrated below), the horizontal direction as depicted in FIG. 2*e*, or a combination/hybrid of these directions as illustrated in FIG. 2*f*. In FIG. 2*g*, a third rail is shown in four-rail system. The third rail 117 is displaced independent of the displacement between the first and second rails 101, 103. This can impart yet another rotation on another axis to the vehicle. This rotation is independent of both the track and the motion from deviation from the first and second rails. In FIG. 2*g*, deviation of the third rail is shown from a first rail. The first and second rails can be displaced from each other in any suitable direction—horizontal, vertical or at any angle. As used herein "vertical" and "horizontal" refer to directions that are respectively vertical and horizontal when the track, vehicle and connection systems are in an upright or normal orientation on the ride, as in the loading position. It is understood that during the ride, in certain track configurations (such as cork-screws, loops, etc.), the "vertical" and "horizontal" directions are not literally vertical and horizontal, and the vertical may be upended, but the reference is still as if in the normal position. In an aspect of the invention, the track is either a three or four-rail system as depicted in FIGS. 2*b*, 2*c* or 2*d* with relative movement of the rails between normal and displaced configuration in a generally vertical direction.

As can be seen, the first, second, and optional third rail can deviate from the normal configuration at any desired angle and. The distance of deviation depends on the configuration of the vehicle system and the connection system, as described below. The amount of rotation of the vehicle is in proportion to the deviation, so maximum deviation corresponds to the maximum extent of rotation of the vehicle. The vehicle can rotate to any extent in any direction. The description below shows a system for rotation of the user from a generally upright position in the normal portion, to a rotated position with head forward and down in the displace portions and back to the normal position as the vehicle passes back into normal portions. However, the rotation may be in the other direction or be in either direction from the normal position by displacing the rails either closer or further apart from a normal configuration. The maximum extent of rotation can be any extent, e.g., through partial arc, a full circle arc or combination of one or more full arcs with partial arcs. Accordingly, the deviation of rails in the track system is coordinated with the motion conversion ratios in the connection system to achieve the desired result. In any event, the track system and connection system are designed in accordance with safety of the rider.

The construction of the first and second rails can be any suitable construction that allows the correct function of the invention as described herein. A suitable construction includes, for example, tubular rails as shown in FIGS. 4 to 7. Other constructions include, but are not limited to, T- or I-beam shaped rails, conventional railroad rails, metal straps, tubular rails of various cross-sections, including circular, ovoid, square, and rectangular, or any other suitable guide-rail construction. The invention also contemplates integrated rail systems where the first and second rails are integrated into a single double-headed rail-unit with two traveling surfaces, such as for example an I-beam or rails with the first and second rails configured as rail heads connected by a web 108, as shown for example in FIG. 2*c*. The web may be solid, a truss system, tie bars, or any other suitable construction. For separate rails, the rails can also be supported by a cage construction outside of the rail path, tie-bars between the rails, or by trestle structures and interconnecting trusses or tie bars between or around the rails. The requirement is that the distance between working or riding surfaces of the first and second rails be allowed to vary, such that the variation interacts or affects structure on the connection system to in turn provides rotation of the vehicle as herein described. In addition, the first rail, the second rail, or both, together with the connection system should have structure to maintain the vehicle on the track system as it travels.

The distance between the first and second rails is determined by engineering principles, considering the configuration of the connection system, the material costs, fabrication, safety, etc., and may vary from ride to ride. However, for many practical installations for roller coaster rides, the distance will vary between about 6 and about 48 inches, (15 cm and 120 cm) preferably between about 24 and about 48 inches (60 and 120 cm).

The track system of the present invention can also contain any other elements known in the art. For example, the at least one of either the first or second rail can have a structure which aids in supporting the weight of the vehicle system. See, for example, U.S. Pat. Nos. 5,595,121 and 6,047,645, the disclosures of which are incorporated herein by reference. In another example, the track system can contain control systems for controlling various aspects of the amusement ride. See, for example, U.S. Pat. No. 6,060,847, the disclosure of which is incorporated herein by reference.

The second major element of the roller coaster, the vehicle system, provides an apparatus in which the rider travels the track system. Any known vehicle system in the art accomplishing such a function can be employed in the present invention. The vehicle systems described below can be employed in the present invention, any number of vehicles systems be provided in the present invention either together (as in a traditional roller coaster) or an assembly of numerous individual (or pairs) of vehicles systems.

The vehicle system can contain any suitable seating system known in the art. Known roller coasters contain seating system, including seats, for the rider that can take any number of configurations. See, for example, U.S. Pat. Nos. 4,531,459, 5,791,254, 6,047,645, and 6,098,549, the disclosures of which are incorporated herein by reference. In one aspect of the invention, the seating system of the present invention can comprise a seat supported by supporting system attached by anchoring system to the frame of the vehicle system. Any suitable supporting system and anchoring system known in the art—including those described in the above patents—can be employed in the present invention.

Figure 3A:
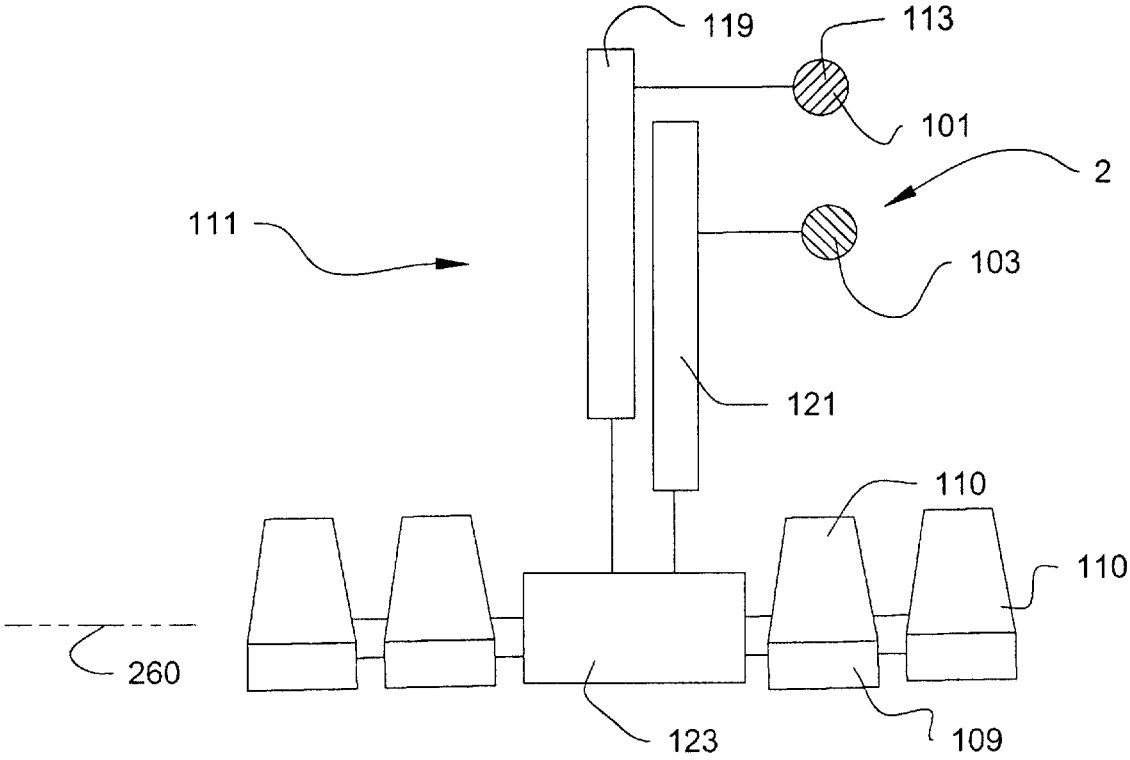
FIGS. 3*a* and 3*b* are schematics illustrating operation and structure of an embodiment of the present invention.
Figure 3B:
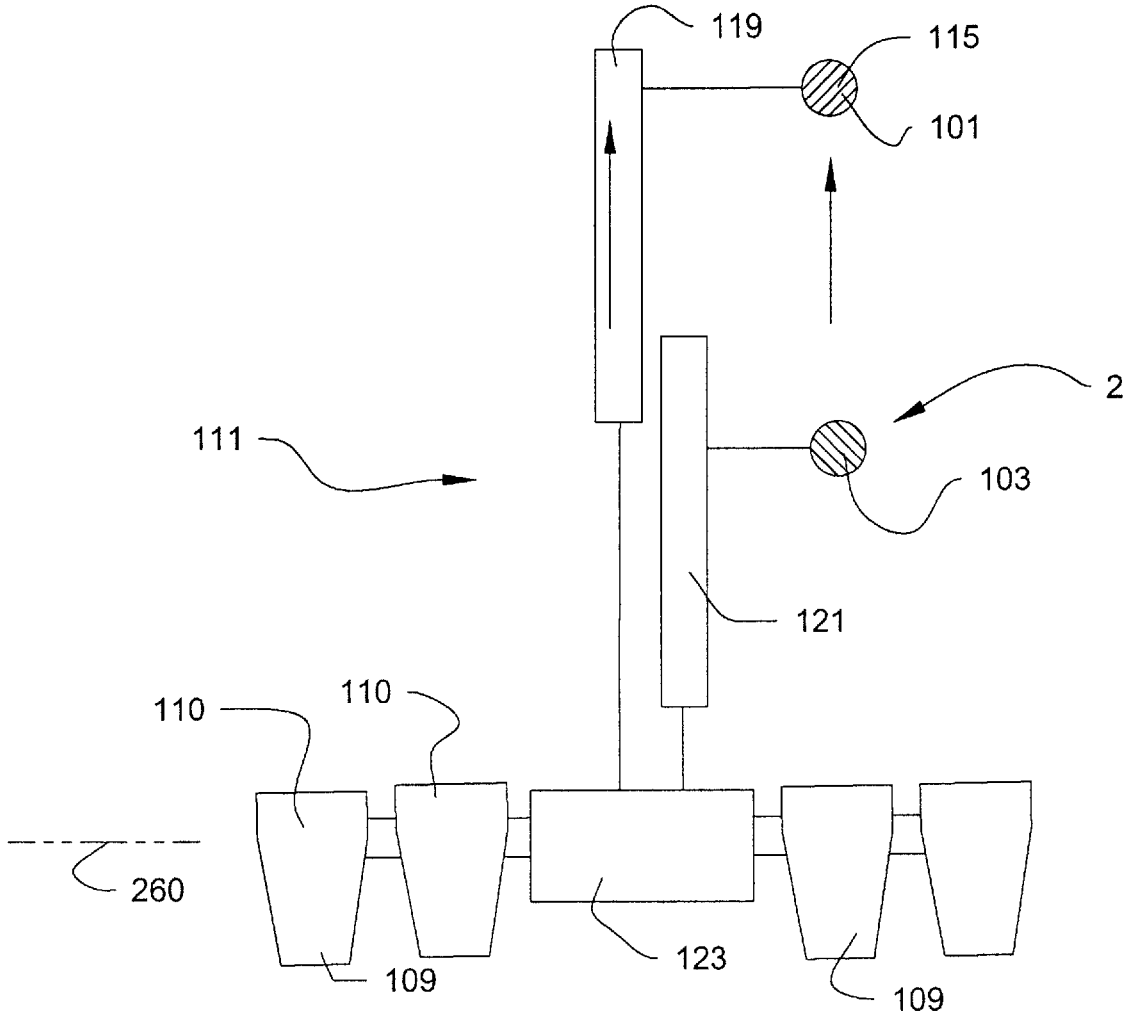

Reference is now made to FIGS. 3*a* and 3*b*. An amusement ride of the invention comprises a track system 1 comprising at least two guiding rails (a first and second rail 101, 103) placed in a normal configuration relative to each other, a vehicle system comprising the vehicle, and a connection system 111 for connecting the track system with vehicle system. The first rail 101 is displaced with respect to the second rail 103 from the normal configuration 113 (FIG. 3*a*) to a displaced configuration 115 (FIG. 3*b*).

A connection system 111 with a first structure 119 moves with and is operably connected to the first rail 101. A second structure 119 of the connection system 111 moves with and is operably connected to the second rail 103. The connection system also comprises structure 123 for converting the relative movement between the first and second structures that is induced by the displacing (shown by the arrows) into a proportional rotational movement around axis 260. The conversion structure 123 applies the rotational movement (shown by the arrows) to the vehicle 110. As illustrated by comparing FIGS. 3*a* and 3*b*, as the vehicle 109 passes from a normal portion as in 3*a* to a displaced portion as in 3*b*, the vehicle 110 with rider has been rotated from an upright to an inverted position. As the vehicle system 101 passes from a displaced portion into a normal portion the operation will be in reverse and the depiction of 3*b* will return to that of 3*a*.

In the description below, the operable connection between the rails and the connection system is through wheels. This is a preferred system as in allows for a low friction travel of the vehicle while allowing structure to retains the vehicle on the track and have the wheels follow the rail displacement. However, it is contemplated that other systems can be used. For example, the operable connection with the first or second rail may be a follower (either sliding or wheeled) that is loaded with spring to maintain it against the rail.

Figure 4:
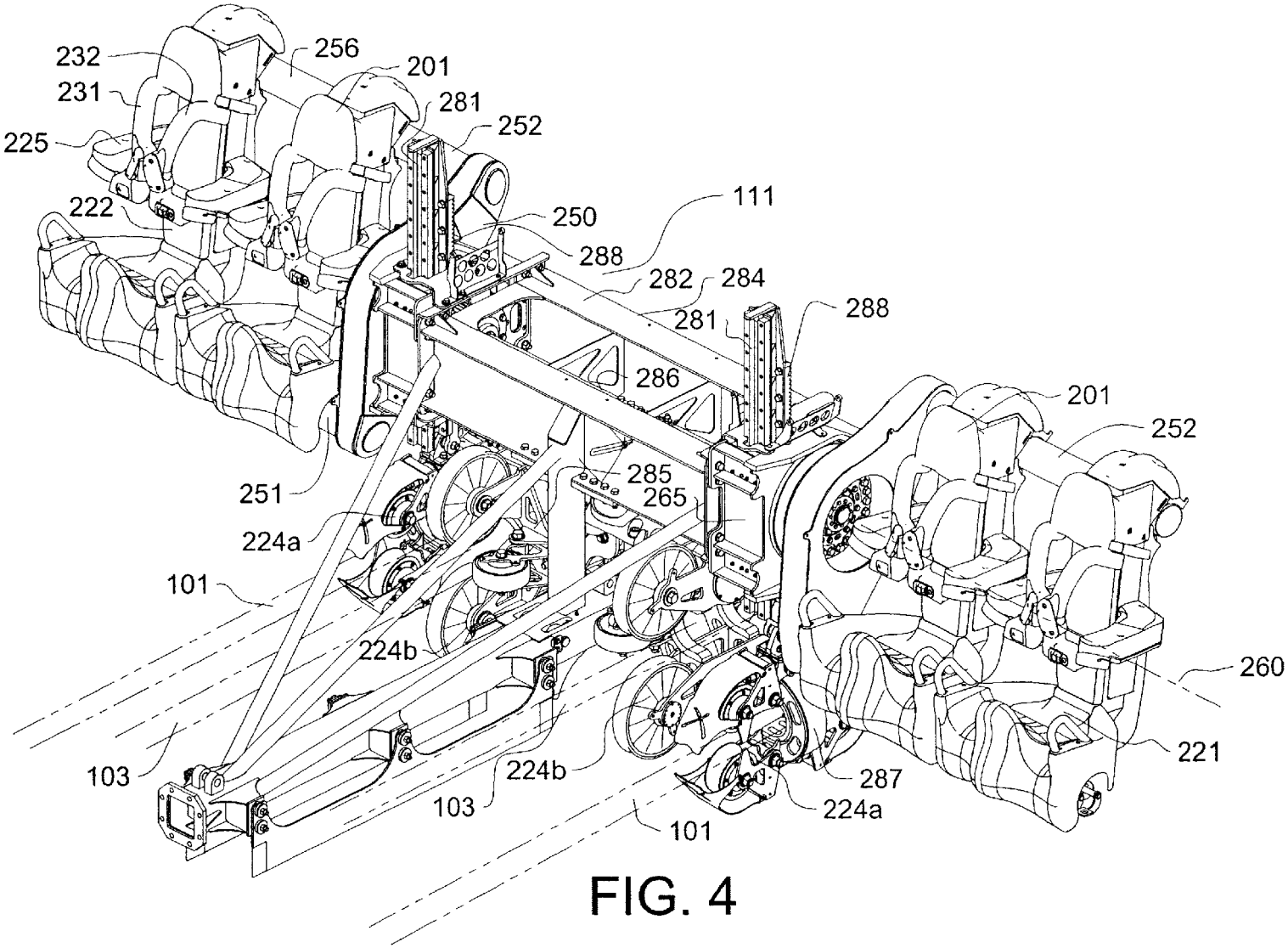
FIG. 4 is a perspective view of an apparatus of the invention in a normal configuration
Figure 5:
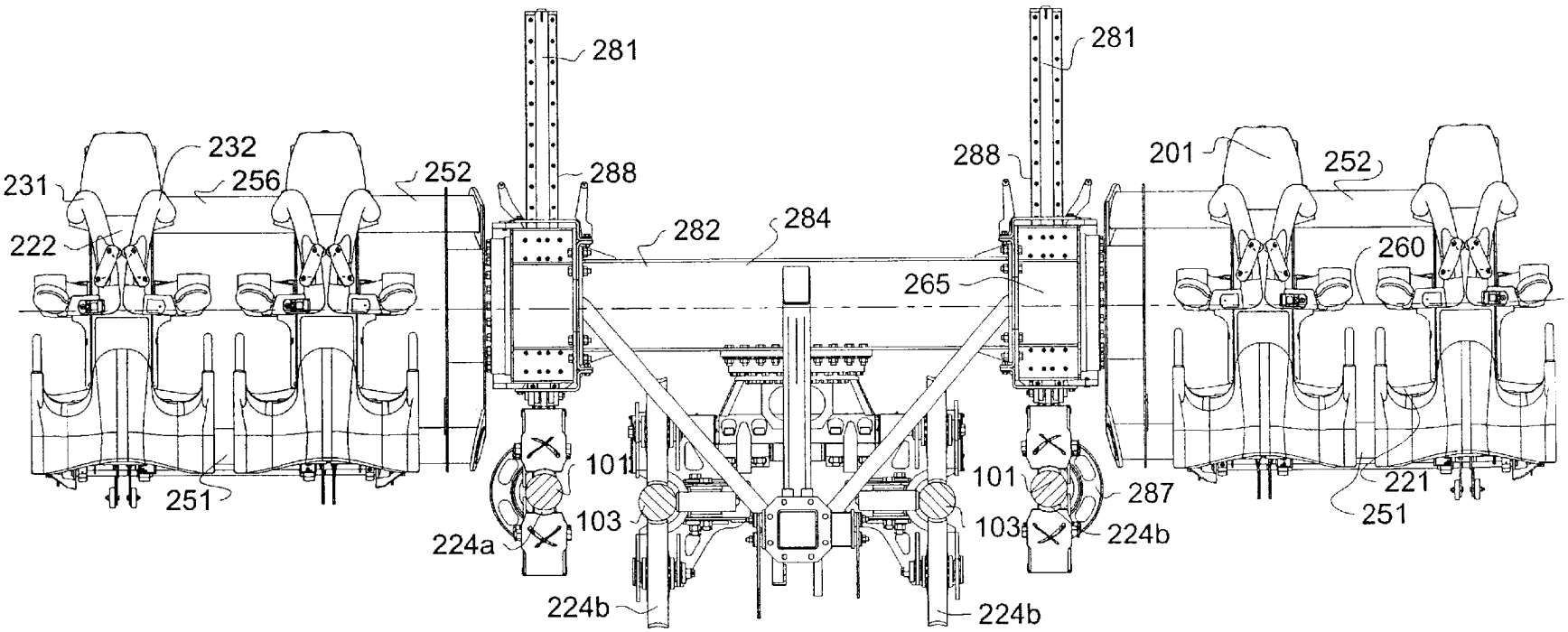
FIG. 5 is the apparatus of FIG. 4 from the front.

Reference is now made to FIG. 4 and FIG. 5. In a preferable aspect of the present invention, the seating system 201 illustrated is employed in the present invention. The seating system comprises a substantially horizontal panel 221 and a substantially vertical panel 222. The horizontal panel is used primarily as a seat for a rider to sit on. The vertical panel is used primarily as a back rest/support when a rider is seated. The horizontal panel and the vertical panel can be a single panel which is bent to the required shape, or can be separate panels that are connected to each other. The horizontal panel and the vertical panel 221, 222 are respectively connected to opposing arms 251 and 252 of the frame 250 (described below). Although two seating systems 201 are illustrated for each vehicle system, additional seating system can be provided for additional riders by appropriately modifying the illustrated vehicle system.

The seating system can optionally contain additional components known in the art for the comfort of the rider. For example, the seating system can contain system for supporting the head, such as a headrest or seat cushion. In another example, the seating system can a contain structure for supporting a rider's arms, such as the arm rests 225 depicted in FIG. 4.

The vehicle system of the present invention contains any suitable restraining systems known in the art. Roller coasters known in the art contain systems for restraining the rider in the vehicle system throughout the ride. Such restraining systems can take any number of configurations. See, for example, U.S. Pat. Nos. 4,531,459, 5,791,254, 6,047,645, and 6,098,549, the disclosures of which are incorporated herein by reference. The restraining systems of the present invention comprises restricting systems and positioning systems. Any suitable restricting system and positioning system known in the art—including those described in the above patents—can be employed in the present invention.

The restraining system illustrated in FIGS. 4 and 5 comprises a pair of restricting arms 231 and 232 (FIG. 5). The restricting arms are open when a rider boards and exits the roller coaster and closed when the rider travels through the roller coaster. The restricting arms are able to rotate from an open position to a closed position using any suitable rotating system, such as a locking hinge allowing the rotating arms to rotate from the open to closed position, but locks in the closed position until released. The closed position of the restricting arms can have numerous configurations because of the different body types and sizes of different riders, e.g., due to the different shapes and sizes of different riders, the restricting arms must be able to "close" in various positions, thereby protecting all riders. The restricting arms can have any suitable configuration of shapes and sizes. The restraining arms restrain the rider against the seating system as the vehicle system travels along the track system. Thus, any known configuration of shapes and sizes known in the art serving this function can be employed in the present invention. See, for example, U.S. Pat. Nos. 5,272,984, 5,433,153, 5,791,254, and 6,098,549, the disclosures of which are incorporated herein by reference. Preferably, the restricting arms of the present invention are configured as shown in FIGS. 4 and 5, with a substantial s-shape to provide more of the body and more contact surface with the body.

The restraining arms of the restricting system in the vehicle system can be vertically adjusted using the positioning system mentioned above. Riders have different heights, and the restricting arms are vertically adjustable to account for each individual height. The restricting arms are vertically adjustable by any suitable system for making the adjustment. The adjusting system is located on the rear of the seating system. Any suitable adjusting system known in the art can be employed in the present invention.

Optionally, when the restraining systems of the present invention are suitably configured, the seating system may be eliminated. The ability to eliminate seating system, while keeping the retaining system, is known in the art. See, for example, U.S. Pat. No. 4,531,459, the disclosure of which is incorporated herein by reference. The seating system should only be removed without jeopardizing the safety of the rider, such as when the rider stands—instead of sits—during the ride.

Typically, most vehicle systems known in the art usually run on the rails of the track system. See, for example, U.S. Pat. Nos. 6,060,847, 5,433,153, and 5,595,121, the disclosures of which are incorporated herein by reference. In other roller coasters, the vehicle system hangs on the side—rather than runs over—the rails of the track. See, for example, U.S. Pat. No. 6,047,645, the disclosure of which is incorporated herein by reference. In other roller coasters, the vehicle system is suspended in some manner over or under the rails of the track. See, for example, U.S. Pat. Nos. 4,170,943, 5,272, 984, 5,791,254, and 6,098,549. In all of these roller coasters, the trajectory of the rider is fixed to be substantially parallel to the rails of the track. The vehicle system of the present invention can have any of these configurations. A suitable configuration for the vehicle system is for hanging on the side of the track as depicted in FIGS. 4 and 5.

Referring to FIGS. 4 and 5, the vehicle system of the present invention contains various structural elements for operation. One structural element is a frame 250 for the vehicle system as depicted. Frame 250 has a general U-shaped configuration with arms 251 and 252 having a straight portion 256. Other configurations and shapes known in the art can be used for the frame. The straight portions 256 of the frame are connected using any suitable system for connecting to the horizontal 221 and vertical panels of the seating system 222. Additional structural elements, such as supporting beams or the like, can be added to the frame as desired.

The frame 250 has the ability to rotate on a rotational axis 260. By rotating, the frame imparts rotation to the seating system, thereby providing a rider with rotational movement. The frame 250 is able to rotate by being connected to any suitable structure that translates the deviation of the rails to a rotation. Any suitable rotating mechanism known in the art can be employed in the present invention. A preferred system is described below.

As known in the art, the vehicle system can also contain any additional elements for any additional functions that are necessary for the operating of a roller coaster. For example, cushions could be added to the horizontal and vertical panels to increase a rider's comfort. In another example, the vehicle system could be enclosed in case of inclement weather. Other elements included safety shields, and various configurations of pads and headrests for the rider.

The third major element of the roller coaster of the present invention is the connection system 111 for connecting the track system and the vehicle system. The connection system includes any components/elements allowing and/or aiding the vehicle system to travel the track system. In particular, the connection system serves several functions. First, the connection system 111 connects the vehicle system 109 and track system 1 (FIG. 1), comprising first and second rails 101, 103, (in phantom) in a removable configuration. Thus, the vehicle system can be removed from the track system and repaired or replaced.

Second, the connection system 111 connects the vehicle system to the track system 1 in a stable and safe configuration. Thus, the riders contained therein are safe while riding in the vehicle system. There are many known connection system satisfying these criteria and, therefore, can be employed in the present invention. See, for example, any of the U.S. patents mentioned above, the disclosures of which are incorporated herein by reference.

Third, the connection system connects the vehicle system with the track system in a manner which, as described herein, translates or converts to rotational movement the displacement movement derived by the connection system from the rail displacement when traveling the track. In other words, as explained more fully elsewhere, a portion of the connection system is displaced when the connection system travels over the track system where the rails are not in a normal configuration. The displaced portion of the connection system is then used to rotate the rotating system of the vehicle system, which causes the frame (and rider) to rotate.

The connection system comprises any suitable system known in the art for traveling along the track system. An example of the traveling system includes wheels for rolling along the rails of the track system. The wheels allow the connection system (and vehicle system) to roll along the track, providing motion to the vehicle system. See, for example, any of the U.S. patents mentioned above, the disclosures of which are incorporated herein by reference.

Figure 4A:
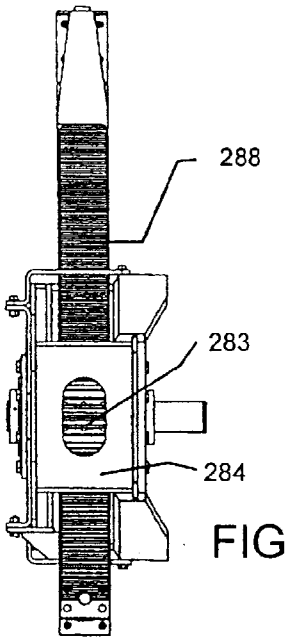

Preferably, the wheel system depicted in FIGS. 4 and 5 is employed in the present invention. The connection system contains first sets of wheels 224*a* and second sets of wheels 224*b*. The first sets 224*a* of wheels rolls along the two first rails 101 while the second sets of wheels rolls 224*b* along the two second rails 103. (In FIGS. 4 & 6 the rails 101 and 103 are shown in phantom.) Each set of wheels contains a plurality of wheels, with at least one wheel being located on an opposing side of the rail that the other at least one wheel. Thus, each set of wheels 224*a*, 224*b* sandwiches a singe rail between them. A pinion gear box 289 containing a pinion gear 283 are mounted to or incorporated into the frame. See detail in FIG. 4*a*, which shows the pinion gear box 289, pinion gear, and rack 288 that engages pinion gear. If there are additional first or second rails, or an optional third rail, additional sets of wheels can be added, as necessary, to sandwich and ride on the rail(s). Any suitable conventional construction can be used for the wheel sets. In the embodiment shown in FIGS. 4–7, second wheel sets 224*b* are mounted on a wheel holder or truck 285 that rotates or swivels on a vertical axis to allow the connection system to follow the track. The first wheel sets 224*a* are mounted on carriers or frames 287 that are connected to the rack 288 by suitable structure that provides some flexibility in the connection and damping to accommodate vibrations and variations in the track.

Figure 6:
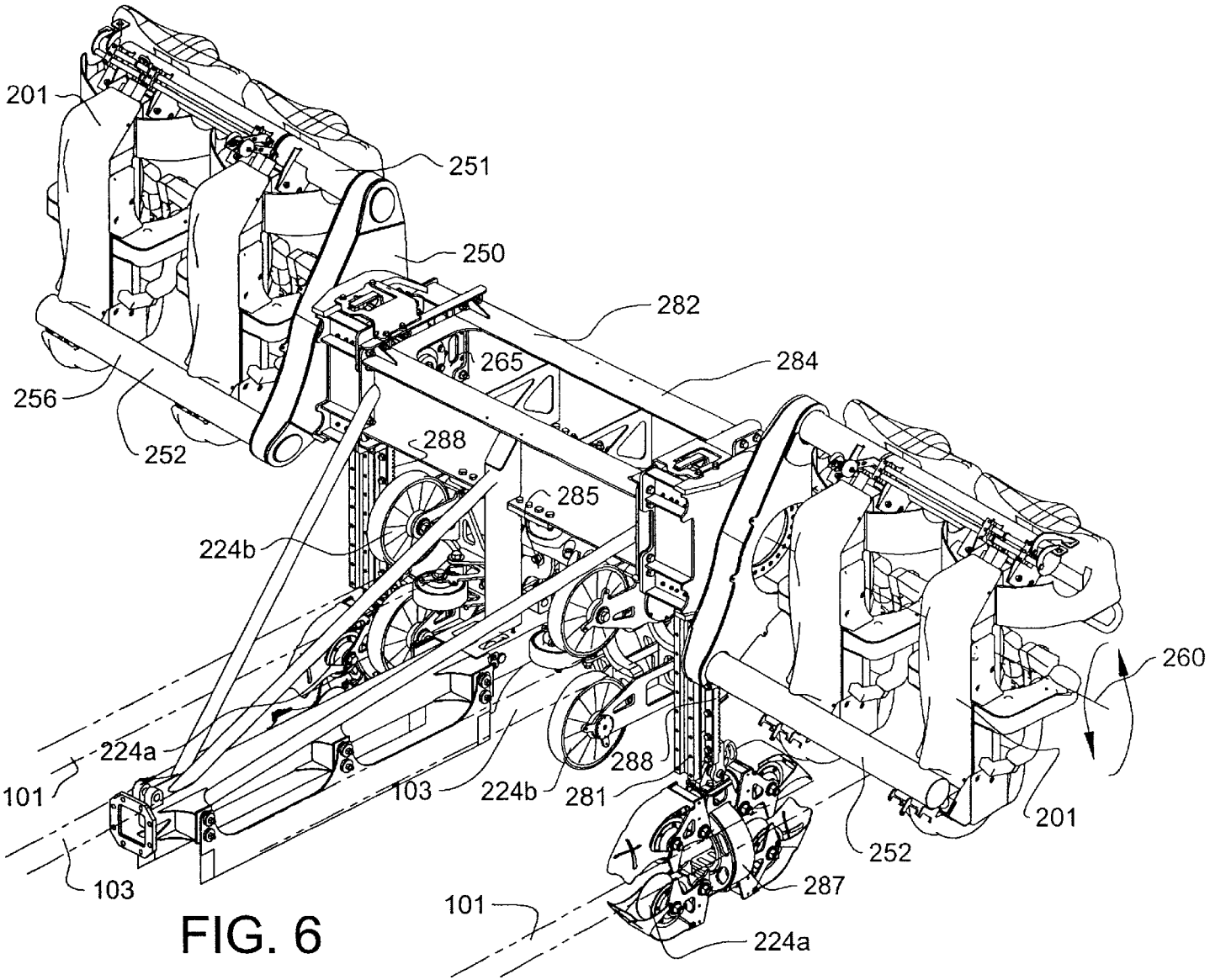
FIG. 6 is the apparatus as in FIG. 4, except the apparatus is in a displaced configuration.
Figure 7:
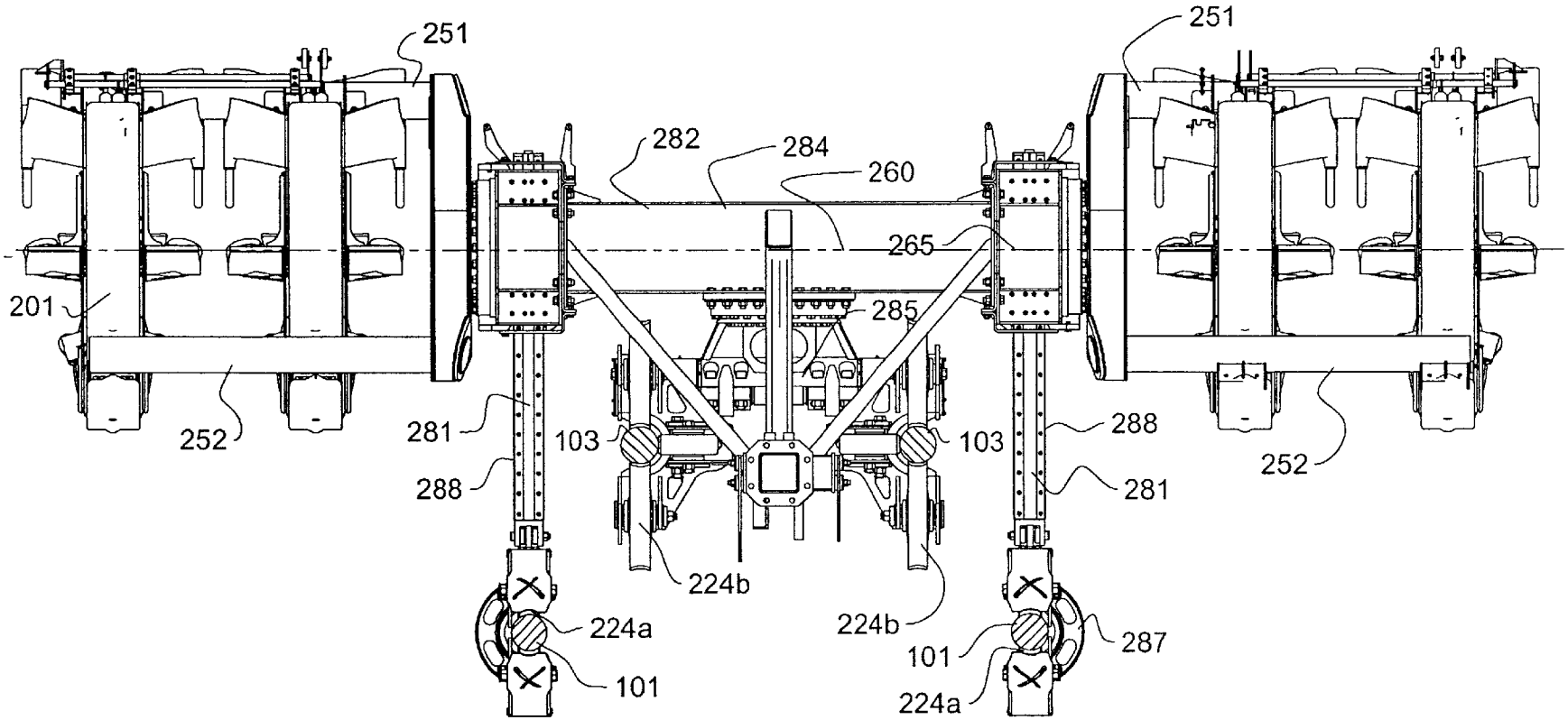
FIG. 7 is the apparatus as in FIG. 6 from the front.

Reference is now also made to FIGS. 6 and 7. FIGS. 6 and 7 are the same as FIGS. 4 and 5, but showing operation of the connection systems in a displaced portion of the track system. FIGS. 4 and 5 show the invention when first and second rails 101, 103 are in a normal configuration. FIGS. 6 and 7 show the invention when first and second rails 101, 103 are in a displaced configuration. The first wheel sets and the second wheel sets are respectively fixed to first and second structures 281, 282 that are operably linked but move independently of each other. The relative movement of these structures caused by movement of the wheels sets over the displaced and deviating rails is translated into rotational movement. In the illustrated embodiment, the first set of wheels 224*a* is fixed through appropriate connections to a rack 288 in the first structure 281, which cooperates with a pinion gear 283. (See FIG. 4A) The second set of wheels is fixed to a frame 284 in the second structure 282 that carries the pinion gear 283. As the first and second wheels sets move together and apart as shown by the arrows, the movement of the rack 288 rotates the pinion 283. The pinion is in turn connected to an axle that is bolted to the frame of the vehicle by any suitable attachment.

Other systems are suitable for translating the relative movement between the first and second wheel sets 224*a* 224*b* to rotary movement. These include other rack and pinion configurations, gearboxes and suitable hydraulic systems. Basically, suitable connection systems include a member fixed to either one of the wheel sets that slides or moves relative to the other wheel set in response to the displacement of the attached wheel set. A second member is fixed to the other wheel set and is operably connected to the first member, so that the relative motion between the wheel sets is converted into work that is converted to rotary motion for the vehicle. This can be through a pinion as shown in the figures, or a rotary hydraulic motor in a hydraulic system. The connection system also comprises suitable sliding bearings and systems, and the like, that support and allow the first and second wheel sets to move relative to one another as described.

Referring again to FIGS. 4 to 7, the pinion 283 is held in gear box 265. The pinion is connected to shaft 286 that extends between the pinions associated with each first second wheel set. The shaft 286 is connected to the vehicle frame 250 though any suitable structure. In the illustrated embodiment, the vehicle frame 250 can rotate through any arc over the full travel of the rack, depending upon the size of the pinion. The rack and pinion may also be reversed to rotate the pinion in the other direction as the rack rises. Rotation can be through a partial arc to one or more full arcs. An arc of 720° has been found suitable. In FIGS. 6 and 7, the vehicle is shown inverted to illustrate the rotation around axis 260, as shown by the arrows in FIG. 6.

The connection system also comprises stabilization structures for stabilizing the various parts of the connection system, including those parts connected to the vehicle system. Any stabilization system known in the art serving the above function can be employed in the present invention. In addition, suitable structure to strengthen components under stress is contemplated. For example, the rack 288 can be strengthened by ribs or other structures. In addition, suitable cams or sliding bearings are provided to hole and provide for the smooth movement of the rack.

As known in the art, the connection system can also contain additional elements for additional functions necessary of an amusement rides, including roller coasters. For example, damping systems to decrease vibrations can be added. In addition, the wheel sets can be made with a longer wheelbase to decrease shimmy. In addition speed regulation systems can be added to the braking systems, or the wheel sets, according to know practice in the art.

The present invention operates in the following manner. With references also to FIG. 1, the track system including the rails 2, both with normal sections and sections with deviated positions, is first manufactured and then constructed. The vehicle system and connection system are then constructed and placed on the track system. The connection system 111 is then connected to the track system 1 in a safe—but secure—method as known in the art consistent with the structure of the connection system.

The vehicle system is then brought to platform 70 where a rider(s) boards. The rider boards the vehicle system and sits on seating and then adjusts the restricting system for the rider's body and pulls the arms into his or her body until the fit is safe and secure. Like other roller coasters, the vehicle system then travels the entire the track system, coming back to platform 70 where the rider disembarks. Due to the configuration of the vehicle system, the rider is suspended on the side of—rather than over—the rails of the track system. In those portions of the track system where the rails are in a normal configuration, the rider's position with respect to the connection system and the axis of the track is substantially constant.

In those portions where the rails are in a displaced configuration, however, the rider experiences an additional rotational movement, and his position rotationally displaced from that in the normal portions. Along these portions of the track system, the displacement of track rails induces the rotational movement of the vehicle and the rider.

The roller coaster of the present invention has been described for a track system (with four rails) with two vehicles on either side of a connection system. However, in accordance with know practice, the system can be expanded by having two vehicles on either side of the connection systems, and connecting connection/vehicle system combinations into a train. A typical configuration comprises a track system with three trains, each train with seven connection systems and four vehicles or rider seats for each connection system.

The invention can also be configured to turn the vehicle on an addition axis, using a third rail(s) as described, or a separate motor. One such axis could be an axis vertical in relationship to the rider. The motors or systems for movement on these axis and other electrical systems imparting different movements can be controlled by a computer system, which in turn can be automatic or respond to input from the rider.

Figure 8:
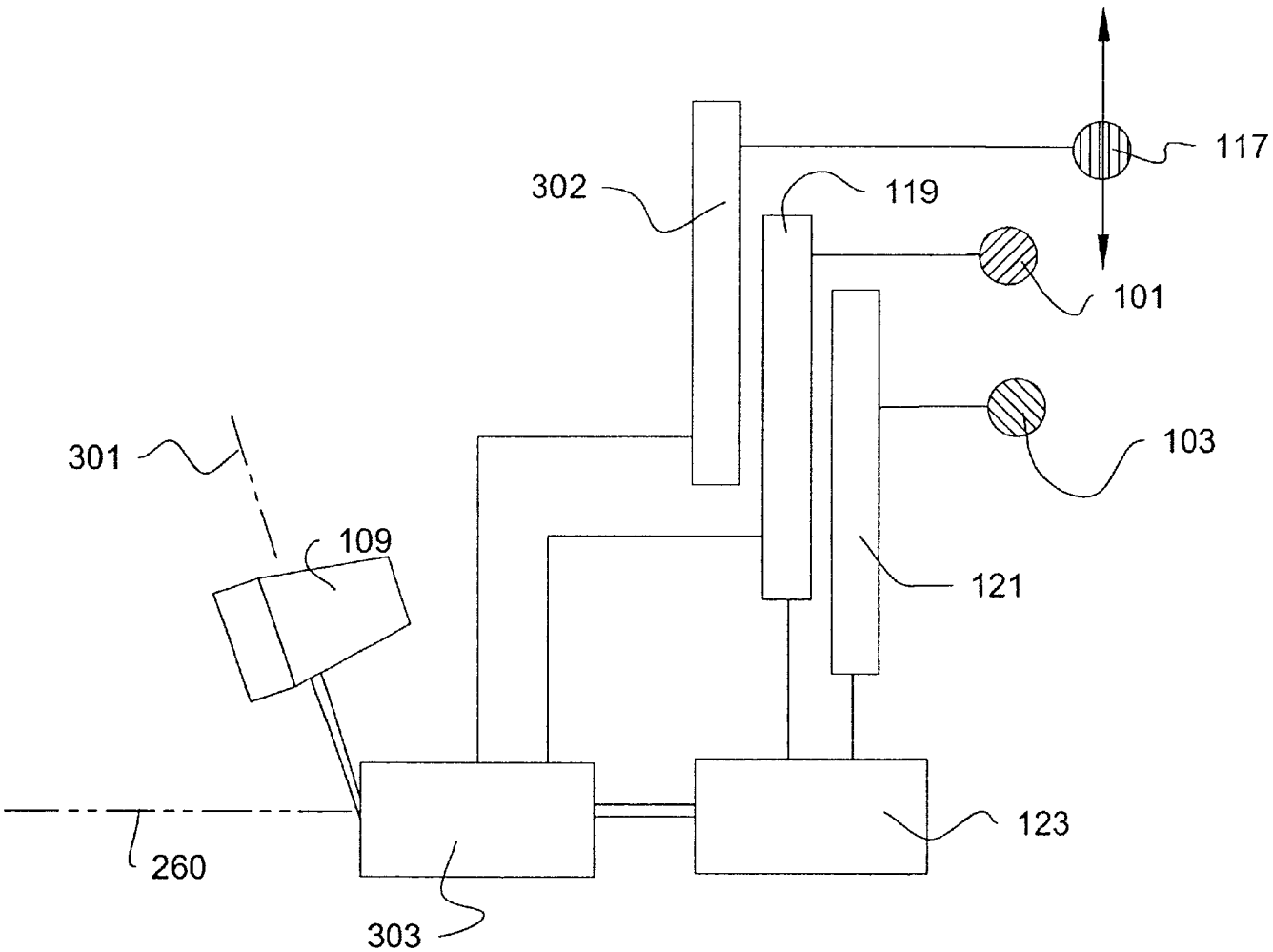
FIG. 8 is a schematic illustrating operation and structure of another embodiment of the invention.

Additional enhancements and modifications, however, can be made. For example, the roller coaster can be configured for a single vehicle system riding on a single set of rails. In another example, additional rails—alone or with additional components—could be added increase the speed of rotation or to simultaneously rotate the vehicle system about a second (and third) axis, or a combination of axis as illustrated in FIGS. 2*g*, and 8. FIG. 8 is a schematic similar to FIGS. 3*a* and 3*b*, showing a secondary motion conversion system 303 with third structure 302 that converts relative motion between the first rail 101 and third rail 117 to rotary motion around axis 301. Such a system could be built as an extension of the system illustrated in FIGS. 5 to 7, using similar or different technology to achieve the rotation about second axis 301 responsive to the displacement between first and third rails 101, 117. In this two axis variation, the second axis could be mounted vertically and perpendicular to the first axis, so that the rider rotates both on a horizontal and vertical axis.

In another variation of the invention, the system of FIGS. 4–7 could be modified by removing the shaft 286 that connects the vehicles and making one of the first rails 101 into a third rail that varies in distance to its corresponding second rail 103. This would allow the vehicles on either side of the connection system to rotate differently from each other on the same axis and give the rider a different ride. The track configuration could be similar to the four-rail configuration depicted in FIG. 2*f*.

In yet another example, the vehicle system could be configured so that the riders sit in a different direction or spin independent of each other. See, for example, U.S. Pat. Nos. 5,791,254 and 6,098,549, the disclosures of which are incorporated herein by reference. In still another example, the present invention could contain components that dampen (or amplify) the amount of the rotation. In even another example, the present invention could contain components that could modify the angle of the rotation. Indeed, the present invention could be configured so that once a rider could selectively de-coupled the vehicle from the connection system, allowing the rider to experience a free spin until coupled again to the connection system for a controlled spin.

Figure 9:
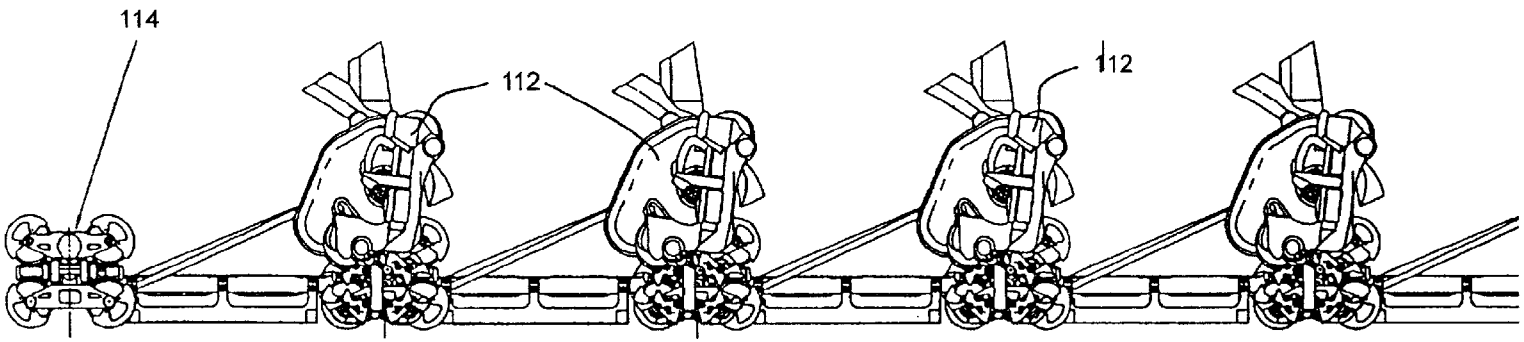
FIG. 9 is a schematic of a train of several units illustrated in FIGS. 4 to 7.

Reference is now made to FIG. 9. For roller coaster-rides, several units or cars or coaches 112 comprising a connection system 111 with vehicle systems 109 (as illustrated, for example in FIGS. 4–7) are connected together into a train. Before the first coach, and/or after the last coach, a leading and/or trailing wheel-set as applicable may be provided to assist in tracking. In the illustration, a trailing wheel-set 114 is shown.

Having described the preferred embodiments of the present invention, it is understood that the invention defined by the appended claims is not to be limited by particular details set forth in the above description, as many apparent variations thereof are possible without departing from the spirit or scope thereof.

What is claimed is:

1. An amusement ride comprising:

a track system comprising at least one first guide rail and at least one second guide rail, the first guide rail and the second guide rail configured in relation to each other in a normal configuration in at least one normal portion of the track system and a displaced configuration in at least one displaced portion of the track system, the normal configuration comprising a generally equidistant spacing between the first and second guide rails throughout the normal portion, the displaced configuration having a displacement from the spacing of the normal configuration to a different spacing between the first and second guide rails in the displaced configuration, a vehicle system comprising a rider-carrying vehicle, a connection system movably connecting the vehicle system to the track system to permit travel of the vehicle system on the track along a track axis, the connection system comprising structure for rotatably displacing the vehicle around a rotational axis independent of the track axis in response to and in proportion to the displacement of the spacing in the displaced configuration.

2. An amusement ride as in claim 1 wherein the rotational axis is in a direction generally perpendicular to the first and second guide rails.

3. An amusement ride as in claim 1 wherein the rotational axis is horizontal and in a direction generally perpendicular to the first and second guide rails.

4. An amusement ride as in claim 1 wherein the vehicle system is located to the side of the track system.

5. An amusement ride as in claim 1 wherein two vehicle systems are located opposite each on either side of the track system.

6. An amusement ride as in claim 1 wherein four vehicle systems are located two on either side of the track system.

7. An amusement ride as in claim 1 wherein there is one first rail and one second guide rail.

8. An amusement ride as in claim 1 wherein there are two first guide rails.

9. An amusement ride as in claim 1 wherein there are two second guide rails.

10. An amusement ride as in claim 1 additionally comprising at least one third guide rail configured in relation to either the first or second guide rail in normal configuration in a portion of the track system and displaced in displaced configuration in a displaced portion, and wherein the connection system rotates the vehicle on a secondary axis not parallel to the rotational axis proportionally to the third rail displacement.

11. An amusement ride as in claim 10 wherein the rotational axis and the secondary axis are perpendicular to the guide rails when in a normal configuration, and the rotational axis is horizontal and the secondary axis is vertical.

12. An amusement ride as in claim 1 additionally comprising at least one third guide rail configured in relation to either the first or second guide rail in the normal configuration in the normal portion of the track system and the displaced configuration in at least a portion of the displaced portion, and wherein the connection system rotates a second vehicle on a second axis proportionally to the third-rail displacement.

13. The amusement ride as in claim 12 wherein the second rotational axis corresponds to the first rotational axis, and the first and second vehicle are disposed on opposite side of the connection system.

14. An amusement ride as in claim 1 wherein the connection system comprises structure that moves proportionally and linearly in response to the displacement, and structure for translating the linear movement to rotational movement for rotating the vehicle on the axis.

15. An amusement ride as in claim 1 wherein the amusement ride is a roller coaster, a flat ride or a tower ride.

16. An amusement ride, comprising:

a track system comprising a plurality of rails with variable non-equidistant spacing between the rails, a vehicle system comprising a vehicle, a system for connecting the track system and the vehicle system to permit travel of the vehicle system along a track axis along the track system and that comprises structure for rotating the vehicle around a rotational axis independent of the track axis in proportion to the spacing between the rails.

17. An amusement ride comprising a track system comprising;

a track system comprising at least two guiding rails placed in a normal equidistant spaced configuration relative to each other and in a displaced configuration where the first and second rails are displaced from the spacing of the normal configuration to a different spacing between the first and second guide rails in the displaced configuration, a vehicle system comprising a vehicle, connection system for connecting the track system with vehicle system to permit travel of the vehicle system on the track system along a track axis, the connection system comprising a first structure that moves with and is operably connected to the first rail and a second structure that moves with and is operably connected to the second rail, and structure for converting the relative movement between the first and second structures that is induced by the displacing into a proportional rotational movement that is applied to rotating the vehicle about a rotational axis independent of the track axis.

18. An amusement ride as in claim 17 wherein the rotational axis is in a direction generally perpendicular to the first and second guide rails.

19. An amusement ride as in claim 17 wherein the rotational axis is horizontal and in a direction generally perpendicular to the first and second guide rails.

20. An amusement ride as in claim 17 additionally comprising at least one third guide rail configured in relation to either the first or second guide rail in normal configuration in a portion of the track system and displaced in displaced configuration in a displaced portion, and wherein the connection system rotates the vehicle on a secondary axis not parallel to the rotational axis proportionally to the third rail displacement.

21. An amusement ride as in claim 20 wherein the rotational axis and the secondary axis are perpendicular to the guide rails when in a normal configuration, and the rotational axis is horizontal and the secondary axis is vertical.

22. An amusement ride as in claim 17 additionally comprising at least one third guide rail configured in relation to either the first or second guide rail in normal configuration in a portion of the track system and displaced in displaced configuration in a displaced portion, and wherein the connection system rotates a second vehicle on a second axis proportionally to the third-rail displacement.

23. The amusement ride as in claim 22 wherein the second rotational axis corresponds to the first rotational axis, and the first and second vehicle are disposed on opposite side of the connection system.

24. A method for imparting rotational movement to a vehicle in an amusement ride comprising a track system comprising at least two guiding rails placed in a normal configuration relative to each other with first and second guide rails equidistantly spaced, a vehicle system comprising the vehicle, and a connection system for connecting the track system with vehicle system to permit travel of the vehicle system on the track system along a track axis, the method comprising;

displacing the spacing between the first rail and the second rail of the guide rails from the normal configuration to a displaced configuration, providing a connection system with a first structure that moves with and is operably connected to the first rail and a second structure that moves with and is operably connected to the second rail, converting the relative movement between the first and second structures that is induced by the displacing into a proportional rotational movement around an axis independent of the track axis, applying the rotational movement to the vehicle.

25. A method for operating an amusement ride comprising:

providing a track system comprising at least one first guide rail and at least one second guide rail, the first guide rail and the second guide rail configured in relation to each other in a normal configuration in at least one normal portion of the track system and a displaced configuration in at least one displaced portion of the track system, the normal configuration comprising a generally equidistant and parallel relative placement between guide rails throughout the normal portion, the displaced configuration comprising displacement of the relative placement of the guide rails guide rails when compared with the normal configuration, providing a vehicle system comprising a rider-carrying vehicle, providing a connection system movably connecting the vehicle system to the track system to permit travel of the vehicle system along the track, the connection system comprising structure for rotatably displacing the vehicle around a rotational axis in response to and in proportion to the displacement of the first and second guide rails, moving the vehicle system over the track system so that the displacement of the first and second rails operably cooperates with the rotatably displacing structure in the connection system to rotate the vehicle.

* * * * *